United States Patent [19]

Thornburgh

[11] 4,137,882

[45] Feb. 6, 1979

[54] EMISSION CONTROL SYSTEM WITH ALTITUDE COMPENSATED PURGE VALVE

[75] Inventor: William F. Thornburgh, Rochester, Mich.

[73] Assignee: General Motors Corporation, Detroit, Mich.

[21] Appl. No.: 826,374

[22] Filed: Aug. 22, 1977

[51] Int. Cl.[2] ..... F02M 59/00

[52] U.S. Cl. ..... 123/136

[58] Field of Search ..... 123/136

[56] References Cited

U.S. PATENT DOCUMENTS 3,683,597 8/1972 Beveridge ..... 123/136

*Primary Examiner*—Ronald B. Cox

*Attorney, Agent, or Firm*—Arthur N. Krein

[57] ABSTRACT

An altitude compensated purge valve is connected in parallel with the vacuum actuated purge valve in the evaporative emission control system for a vehicle engine whereby to control as a function of ambient pressure the purging of fuel vapors from a fuel vapor storage canister into the vehicle engine for combustion therein. The altitude compensated purge valve includes an aneroid actuated tapered valve to variably control the flow area through an inlet passage from the canister for controlling vapor purge therefrom to a common fuel vapor line connecting both the vacuum actuated purge valve and the altitude compensated purge valve to the induction system of the engine.

2 Claims, 2 Drawing Figures

EMISSION CONTROL SYSTEM WITH ALTITUDE COMPENSATED PURGE VALVE

This invention relates to an evaporative emission control system for an automotive vehicle and, in particular, to such a system having an altitude compensated purge valve incorporated therein.

SUMMARY OF THE INVENTION

Evaporative emission control systems of various types are presently used in automotive vehicles for controlling the loss of fuel vapor from the vehicle fuel tank and from the carburetor float bowl, if the latter is used, in a vehicle. In one such system, a fuel vapor storage canister containing, for example, activated charcoal is connected to a vapor line from the vehicle fuel tank and from the carburetor float bowl, if used, for storage of the fuel vapor emitted therefrom. During vehicle operation, the fuel vapor is purged from the canister into the engine induction system for combustion within the engine, the fuel vapor flow being controlled by a vacuum actuated purge valve.

Since in such a system the fuel vapor is supplied to the engine together with the normal metered quantities of liquid fuel during engine operation, the fuel vapor is normally metered through at least one control orifice, flow through which is controlled by the vacuum actuated purge valve, for proper engine function. In such a system, the flow control orifice is sized to produce the desired purge rate of fuel vapor and is sized so as not to cause excessive leaning of the induction mixture delivered to the engine when the canister is dry and only air is being purged. In order to obtain the desired purge rate, it has been necessary to provide one size flow control orifice for use on vehicles sold for normal operation from sea level up to some predetermined altitude, such as 4,000 feet, whereas a larger size flow control orifice is provided for use on those vehicles sold for normal operation at an altitude above the predetermined altitude, that is, at an altitude or elevation above 4,000 feet. A large sized orifice is provided for higher altitude operation because evaporative emissions increase with altitude thus causing more fuel vapors from the gas tank, and from the carburetor fuel bowl, if used, to be stored in the canister during diurnal and hot soak conditions. If the canister is not completely purged of fuel vapors during engine operation, it is then possible that overloading of the canister can occur which would cause fuel or vapor breakthrough from the canister resulting in high evaporative emissions. Thus during engine operation, it is desirable to preferably, completely purge the fuel vapors from the canister whereby its capacity is fully regenerated so that it can then be operative to store fuel vapor to its maximum design capacity.

From the above, it will be apparent that, if a small sized orifice is used in the conventional vacuum actuated purge valve to produce the desired purge rate during engine operation from sea level up to some predetermined altitude, and this orifice has been properly sized so as not to excessively lean the mixture when the canister is dry and only air is being purged, when such an equipped vehicle is then operated at an elevation above the predetermined altitude, complete purging of all the fuel vapor from the canister may not be accomplished during engine operation. On the other hand, if the vehicle is equipped with a large flow control orifice, as required for high altitude use, and then such vehicle is operated at an elevation below the predetermined altitude all the way to sea level, the fuel vapors would be rapidly purged from the canister and then, when only air flows from the canister, the air-fuel mixture being supplied to the engine may be leaned excessively.

This invention provides an emission control system with an altitude compensated purge valve whereby proper purging of fuel vapors from the canister will occur at all altitude levels of engine operation.

In accordance with the invention, a purge valve having an aneroid incorporated therein for compensating the purge rate of fuel vapor flow from the vapor storage canister in an evaporative emission control system is used in parallel to the vacuum actuated purge valve of such a system.

The details as well as other objects and advantages of this invention are shown in the drawings and are set forth in the detailed description of the preferred embodiment.

DETAILED DESCRIPTION OF THE PREFERRED EMBODIMENT

Figure 1:
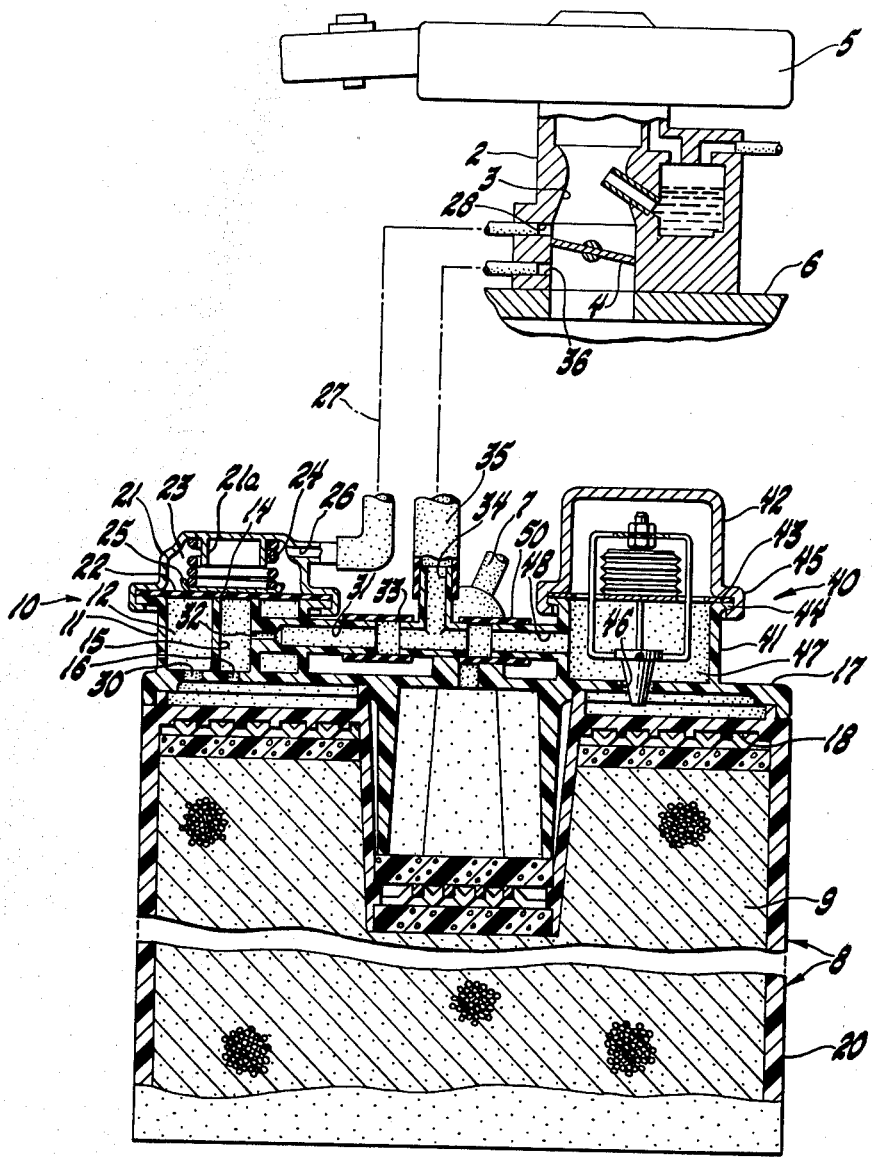
FIG. 1 is a schematic plan view, partly taken in section, of a portion of an evaporative emission control system for a vehicle engine, the system having incorporated therein an altitude compensated purge valve in accordance with the invention; and, FIG. 2 is an enlarged sectional view of the altitude compensated purge valve of FIG. 1.
Figure 2:
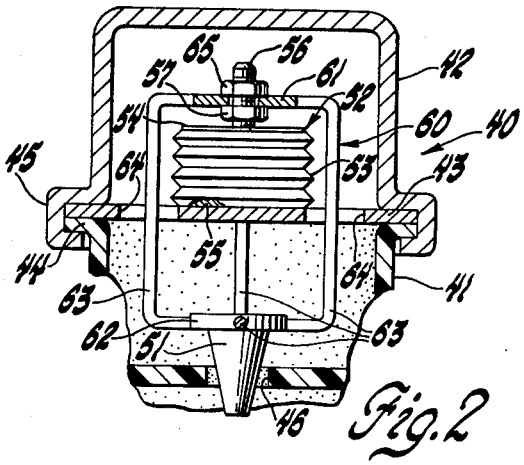

Referring to the drawings and, in particular, to FIG. 1, an internal combustion engine, not shown, has an induction system including a carburetor 2 having an induction passage 3 therethrough with flow through the induction passage controlled by a throttle valve 4, and a conventional air cleaner 5 mounted on the carburetor. Induction fluid flowing through the induction passage 3 is delivered to the intake manifold 6 of the engine for supplying induction fluid to the combustion chambers, not shown, of the engine.

The engine receives fuel from a reservoir or fuel tank, not shown, in a conventional manner. This reservoir or fuel tank has at least one vent line 7 which extends preferably via a liquid vapor separator, not shown, which is connected to the inlet of a fuel vapor storage canister 8. The fuel vapor storage canister 8 may be of any suitable type known in the art. In the construction illustrated, the canister 8 is of the type disclosed in U.S. Pat. No. 3,683,597 entitled "Evaporation Loss Control" issued Aug. 15, 1972 to Thomas R. Beveridge and Ernst L. Ranft. Such a canister 8 contains an absorbent, such as activated charcoal or carbon 9, and the bottom of the canister is open to atmosphere so that atmospheric air may be drawn through the carbon to purge the fuel vapor therefrom during engine operation in the manner disclosed in the above identified U.S. Pat. No. 3,683,597.

During engine operation, fuel vapor stored in the canister 8 is purged for induction into the engine for combustion therein. Conventionally, the flow of fuel vapor from the canister to the engine is controlled by a suitable purge valve, such as the vacuum actuated purge valve 10. In the construction illustrated, this vacuum actuated purge valve 10 is of the type disclosed in copending U.S. patent application Ser. No. 764,866, entitled "Emission Control System with Integrated Evaporative Canister Purge" filed Feb. 2, 1977 in the name of Charles A. Kingsley, assigned to the same assignee as the subject application.

As shown, the purge valve 10 includes a valve housing or body that includes a cup-shaped base 11 providing a first compartment 12 having an upstanding valve seat 14 therein, as provided by the upper end of an annular boss that has a passage 15 therethrough, the passage 15 including a flow control orifice 16 of a predetermined size at the lower end of the passage, this orifice 16 also being referred to as a constant purge orifice, for a reason which will become apparent.

Although the base 11 can be formed as a separate element, in the construction illustrated, it is formed as an integral part of the canister cover 17 which is secured to and encircles the open grid end 18 of the outer casing 20 of canister 8. The canister cover 17 and outer casing 20, including its open grid end 18, are molded, for example, from heat stablized nylon.

A cover member 21, of inverted, substantially cup shape, is suitably secured to the base 11 and a flexible diaphragm 22 is suitably sandwiched at its outer peripheral edge between the secured together opposing end flanges of the base 11 and cover member 21. The diaphragm 22 forms, with the cover member 21, a vacuum chamber 23 and separates this chamber 23 from the compartment 12 in the base 11. A coiled spring 24 is positioned within the chamber 23 to have one end thereof abut against a spring retainer disk 25 in abutment on one side and centrally of the diaphragm 22 and has its other end abutting against the inner surface of the cover member 21, the spring 24 being centered by an annular boss **21*a* depending from the inner surface of the cover. With this arrangement, the diaphragm 22 is normally biased by the spring 24 against the valve seat 14 blocking flow from the compartment 12 into the passage 15**.

The cover member 21 is also provided with a signal vacuum passage 26, which at one end is in communication with the vacuum chamber 23 and at its other end is connected by a hose 27 to a port 28 opening into the induction passage 3 in the throttle body above the throttle valve 4 whereby a ported or controlled vacuum signal can be applied in the vacuum chamber to one side of the diaphragm 22 during engine operation.

The compartment 12 in the base 11, which is separated by the diaphragm 22 from the vacuum chamber 23, is provided with an inlet, timed purge, orifice passage 30 thereto, of predetermined size, which is formed in the base 11 and which is suitably connected for communication with the interior of the canister 8. The constant purge orifice 16 end of passage 15 is also suitably connected for communication with the interior of the canister 8. For example, in the construction illustrated, both this orifice passage 30 and the orifice 16 end of passage 15 are placed in communication with the interior of the canister 8 by the openings extending through the open grid end 18 of the outer casing 20 of the canister, the structure of the open grid end 18 being similar to the corresponding structure shown in the above identified U.S. Pat. No. 3,683,597.

The base 11 is also provided with a side passage 31 that includes a purge flow control orifice 32 of predetermined size, the passage 31 extending through the annular boss portion of the base 11 to intersect the passage 15 therethrough intermediate its ends, that is, between the valve seat 14 end thereof and the orifice 16 end thereof. The opposite end of the passage 31 is connected by a hose 33 to a tee connection 34, the tee connection 34 being used for a purpose to be described hereinafter, and by a conduit or hose 35 to, for example, the induction vacuum port 36 in the throttle body that opens into the induction passage 3 below the throttle valve 4.

As illustrated, valve seat 14 is substantially centered relative to the compartment 12 and, the boss, on which the valve seat is formed, is of a predetermined outside diameter and, of course, the passage 15 therethrough is also of predetermined diameter. The various elements of the purge valve 10 are shown in their at rest position with the diaphragm 22 in seating engagement with the valve seat 14.

During engine operation, engine induction vacuum, as sensed at the port 36, is applied through side passage 31, purge flow control orifice 32 and passage 15 to one side portion of the diaphragm 22 which is normally seated against the valve seat 14, as biased by the spring 24, so that there is no flow of vapor via compartment 12 into passage 15 to the induction passage. However, continued purging of a controlled amount of fuel vapor from the canister 8 during engine operation will occur since the induction vacuum signal in passage 15 will draw air and fuel vapor through the canister through the constant purge or flow control orifice 16. It will be apparent that the level of induction vacuum signal in the passage 15 of purge valve 10 will be substantially less than in the induction passage 3 due to the flow of atmospheric air into the bottom of canister 8 and then of air and fuel vapor from the canister through the constant purge orifice 16 with this air-fuel vapor then passing through the purge flow control orifice 32 on into the induction passage 3.

At the same time, the ported vacuum signal, as sensed at port 28, is applied to the vacuum chamber 23 and, as this signal develops sufficient force to overcome the preload of spring 24 and the induction vacuum force on the small area of diaphragm 22 acted upon by the vacuum in passage 15, unseating or opening of the diaphragm relative to the valve seat 14 will occur and modulated flow of additional fuel vapor through orifice passage 30 and compartment 12 will begin to occur as air is drawn into the canister, with the flow of air and vapor controlled by the size of the purge flow control orifice 32, in the manner more fully described in the above identified U.S. patent application Ser. No. 764,866.

In the above vacuum actuated purge valve 10 structure, the purge flow control orifice 32 of this device, in one embodiment, would be 0.085 inch in diameter for use with the engine of a vehicle intended for normal use from sea level up to a predetermined altitude whereas, for use above the predetermined altitude, that is, normal use of the vehicle above 4,000 feet in accordance with current Federal Regulations, this orifice would have a 0.120 inch diameter. Thus, if the vehicle provided with the large diameter purge flow control orifice is used at low altitude, that is, at altitudes down below 4,000 feet, for example, at sea level, fuel vapor would be purged from the canister 8 very rapidly and, once the fuel vapor has been purged, then the engine may be operating too lean since then only air would be drawn through the canister whereas, if the vehicle provided with the small diameter purge flow control orifice is used at a relatively high altitude, for example, above 4,000 feet, the vapor purge rate may be insufficient during an operating engine cycle to effect complete purging of fuel vapor from the canister. If this occurs, then after engine shut-down during diurnal and hot soak conditions, the canister may not have sufficient capacity to then absorb the fuel vapors being admitted from the fuel tank and, if this occurs, vapor may then break out from the canister.

Now in accordance with the invention, the evaporative emission control system, thus far described, further includes an altitude compensated purge valve, generally designated 40. This altitude compensated purge valve 40, in the construction illustrated, includes a partly enclosed housing provided by a cup-shaped base 41 and an inverted cup-shaped cover 42 with a perforated support disk 43 sandwiched between the end flanges 44 and 45 of the base 41 in cover 42, respectively, these elements being suitably secured together as by rolling the flange 45 over flange 44. Although the base 41 is shown as being formed as an integral part of the canister cover 17, it will be apparent that it can be formed as a separate element.

Base 41 is provided with a vapor inlet passage 46 that opens into the interior chamber 47 of the purge valve, as provided by the base 41 and cover 42, the inlet passage 46 at its other end being connectable for communication with the interior of the canister 8, as by the openings extending through the open grid 18 of the canister. Base 41 is also provided with a vapor outlet passage 48 opening at one end into the chamber 47 and being connectable at its opposite end to the engine induction system as by connection to the induction vacuum port 36, by having the outlet passage 48 connected by a hose 50 to a side passage of tee 34. Tee 34, as previously described, is connected by hose 35 to port 36, whereby the outlet of the purge valves 10 and 40 are, in effect, functionally connected in parallel for supplying fuel vapor to the induction system of the engine.

Flow of fuel vapor through the purge valve 40 is controlled by a tapered, valve element 51 positioned for movement to control the effective flow area through the vapor inlet passage 46 as a function of ambient pressure variations by means of an aneroid 52. The evacuated aneroid 52, which includes a bellows 53 and upper and lower bellows end plates 54 and 55, respectively, is concentrically positioned relative to the vapor inlet passage 46 as by having the end plate 55 suitably fixed to the support disk 43. At its opposite end, the aneroid 52 is provided with an externally threaded support stud 56 fixed to and upstanding from the end plate 54, the support stud carrying a support platform 57, which in the construction illustrated is in the form of a nut adjustably threaded onto the support stud. The support platform 57 operatively supports a wire-like, open, valve cage 60 to which the valve element 51 is fixed for movement therewith. In the construction illustrated, the valve cage 60 includes an apertured upper annular base 61 through which the support stud 56 extends, a lower annular base 62, with these two bases being connected together by circumferentially spaced apart U-shaped support legs 63, four such legs being used in the construction illustrated, with each leg 63 extending through a corresponding aperture 64 in the disk 43. As shown, the valve element 51 is secured to depend from the lower base 62. If desired, a second nut 65 can be threaded onto the support stud 56 to effectively lock the valve cage 60 to the support platform 57, as illustrated.

With this arrangement, the effective height of the upper end plate 54 relative to support disk 43 and, therefore, the axial position of the valve element 51 relative to the vapor inlet passage 46 will vary due to changes in elevation at which the engine is operating or due to other barometric pressure changes. Valve cage 60 is suitably positioned relative to the upper end plate 54 of the aneroid 52 to position the valve element 51 so that, with the engine operating at high atmospheric pressure, such as at sea level, the valve element 51 is positioned to provide a constant purge bleed orifice of predetermined flow area for the purging of fuel vapor from the canister 8 through the vapor inlet passage 46 whereas, as the ambient pressure decreases due to increases in elevation or barometric changes, the flow area through the vapor inlet passage 46, as controlled by the valve element 51, increases to thereby increase the vapor flow purge rate from the canister to the engine. It will readily be apparent to those skilled in the art that the valve element 51 of the altitude compensated purge valve 40 can readily be calibrated, as desired, to increase purge proportionally or at an increasing rate upon changes in ambient pressure to achieve the desired fuel vapor purge rate for a particular evaporative emission control system.

With the subject altitude compensated purge valve 40 connected in parallel with the discharge from the purge valve 10, in the manner described, for example, it will now be apparent that the purge flow control orifice 32 of the purge valve 10 and the calibration of the constant purge bleed orifice of the purge valve 40 can be selected so that the combined purge rate of fuel vapor from the canister 8 to the engine is of a predetermined rate for engine operation at an ambient pressure corresponding to the pressure at sea level with the purge rate increasing, as desired, as the ambient pressure decreases due to increases in elevation or other barometric changes, by operation of the purge valve 40 which automatically effects this increase in purge rate in the manner described, while the flow rate of purge valve 10 is controlled by the purge flow control orifice 32 in the normal manner for this latter type purge valve.

What is claimed is:

1. In a fuel vapor purge system for a vehicle having a fuel vapor storage canister receiving fuel vapor from a fuel reservoir means used to supply fuel to an internal combustion engine, the engine having an induction passage with flow therethrough controlled by a throttle valve, the induction passage having a ported vacuum port therein traversed by the throttle valve and an induction vacuum port located below the throttle valve, the fuel vapor purge system including a vacuum actuated purge valve having at least one purge inlet in communication with said canister for receiving fuel vapor therefrom, a purge outlet with an orifice restriction therein in communication with said induction vacuum port and with a diaphragm actuated valve means therein controlling flow from said purge inlet to said purge outlet with one side of said diaphragm actuated valve means being connected to said ported vacuum port, the improvement wherein said fuel vapor purge system further includes an altitude compensated purge valve connected in parallel with said purge outlet of said vacuum actuated purge valve to said induction vacuum port, said altitude compensated purge valve including a housing having an inlet connected to said canister to receive fuel vapors therefrom and an outlet connected to said induction vacuum port and, an aneroid actuated valve means in said housing operatively positioned to control fuel vapor flow from said canister through said inlet into said housing as a function of atmospheric pressure such that at high atmospheric pressure, corresponding to operation of the engine at low altitude, the flow through said inlet is substantially restricted and at low atmospheric pressure, corresponding to operation of the engine at high altitude, the flow through said inlet increases.

2. An altitude compensated purge valve for use in a system for controlling loss of fuel vapor from a vehicle having a fuel reservoir, an internal combustion engine with a throttle valve controlled induction passage, a vapor storage canister receiving fuel vapor emitted from the fuel reservoir and a vacuum actuated purge valve, having an inlet connected to the canister and an outlet to the induction passage, for controlling flow of fuel vapor from the canister to the engine as a function of engine operation, said altitude compensated purge valve including a housing means providing a chamber therein and an inlet to said chamber connectable to said canister and an outlet connectable to said induction passage, an aneroid means positioned in said chamber with one end of said aneroid being fixed to said housing means against movement thereto and, valve means operatively fixed to the opposite end of said aneroid for movement therewith and positioned to control vapor flow from said canister through said inlet to said outlet, said valve means being positioned so that the purge rate of flow from said canister increases as ambient pressure decreases due to increases in elevation at which the vehicle operates and as barometric pressure decreases.

* * * * *